United States Patent [19]

Eller

[11] 3,973,454

[45] Aug. 10, 1976

[54] STRIPPER INSERT AND METHOD OF MAKING AND USING THE STRIPPER INSERT

[75] Inventor: Stanley H. Eller, Burton, Mich.

[73] Assignee: Stripper Insert Corporation, Detroit, Mich.

[22] Filed: Nov. 7, 1975

[21] Appl. No.: 630,066

[52] U.S. Cl. ..... 83/55; 83/140

[51] Int. Cl.[2] ..... B26F 1/14; B26D 7/00

[58] Field of Search ..... 83/138, 139, 140, 55

[56] References Cited

UNITED STATES PATENTS

| | | | |
|---|---|---|---|
| 1,822,468 | 9/1931 | Wales | 83/140 |
| 3,496,818 | 2/1970 | Porter et al. | 83/140 |
| 3,540,339 | 11/1970 | Killaly | 83/140 |

*Primary Examiner*—Willie G. Abercrombie
*Attorney, Agent, or Firm*—Cullen, Settle, Sloman & Cantor

[57] ABSTRACT

This disclosure relates to a stripper insert, and to a method of making and using the insert in a sheet punching apparatus. The stripper insert is comprised of a plastic component inserted within a cup-shaped metallic retainer plate. The retainer plate includes a base for engaging and stabilizing sheet material during a punching operation, with a flange peripherally circumscribing the base and extending generally perpendicular thereto. The plastic component also includes a base which is peripherally received by the retainer plate flange. In one embodiment, an axial bore is formed through the base of both the plastic component and the retainer plate by a reciprocal punching tool while the component parts of stripper insert are secured in position on the sheet punching apparatus. In a second embodiment, the retainer plate includes a previously formed opening, and an axial bore is formed in only the plastic component by the punching tool.

10 Claims, 4 Drawing Figures

STRIPPER INSERT AND METHOD OF MAKING AND USING THE STRIPPER INSERT

BACKGROUND OF THE INVENTION

1. Field of the Invention

The present invention relates to a method and apparatus for punching sheet material, and more specifically to a stripper insert component utilized during the sheet punching operation.

2. The Prior Art

In the manufacture of sheet material having punched openings, the sheet material is positioned on a lower die shoe for support in alignment with a vertically reciprocal punching tool. A vertically moveable die pad is generally interposed between the reciprocal punch and the lower die shoe and includes a bore therethrough to accommodate the vertical movement of the punch, the pad serving to engage, flatten, and stabilize the sheet material during the punching operation.

It has also been found desireable to utilize a so-called stripper insert positioned in the pad bore. The insert generally includes an opening therethrough to closely receive the punching tool, serving to further flatten the sheet material locally of the punched region. Further, the insert holds the sheet material against the lower die shoe while the punch is retracted, to eliminate the formation of a burr around the periphery of the punched opening.

Various types of stripper inserts have been used in punching operations, one such insert including a thick metal body for engaging and stabilizing the sheet material. This insert, however, has several inherent disadvantages. For example, the insert bore must be accurately machined and then the insert must be rather precisely positioned in mating alignment with the reciprocal punch. Further, if an irregular shaped insert bore is required because of the punch configuration, the insert must be cut in half for milling operations and then welded back together for placement in the punching die.

The present invention overcomes these and other disadvantages through a novel insert that can be secured in position on the punching die and then punched by the reciprocal punching tool to form the desired insert bore configuration.

SUMMARY OF THE INVENTION

This application relates primarily to a stripper insert for attachment to a sheet punching die in alignment with a reciprocal punching tool. The stripper insert includes a cup-shaped retainer plate frame formed of thin sheet metal material, the retainer frame including a generally planar base segment having a flat surface for engaging, flattening, and stabilizing sheet material locally of the region in the sheet material that is to be punched. A collar or flange extends upwardly from the retainer base for receiving a second component of the stripper insert, namely a plastic reinforcing component. The reinforcing component includes a base inserted within the cup-shaped retainer frame and an annular, upwardly directed leg extending from the base portion thereof, the upwardly directed leg having a blind bore therethrough to freely receive the punching tool during the punching operation.

According to this invention, a bore or opening is formed axially through the stripper insert during the sheet punching operation. Therefore, several advantages are provided over the prior art, including: (1) the elimination of milling operations for the stripper insert; (2) the ability to accurately relocate the stripper insert in the punching apparatus after removal therefrom; and (3) the provision of a commercially feasible, easily assembled stripper insert which eliminates or minimizes the formation of a burr around the edge of a punched opening in sheet material.

The stripper insert is positioned within and punched by a conventional punching apparatus in two alternative methods. In a first alternative method, the retainer cup alone is secured to a vertically moveable die pad and punched by a reciprocal punching tool. After removal of the punched retainer cup from the die pad, the plastic component is inserted within the cup, and the thus-assembled stripper insert is secured to the die pad. The plastic component is then punched to form aligned, substantially identical openings in the retainer cup and the plastic component.

In a second disclosed method of assembly, the plastic reinforcing component is axially inserted into the cup-shaped metal retainer frame. Then, the thus-assembled stripper insert is axially inserted into a complementary-shaped bore in a vertically moveable die pad of the punching apparatus. The moveable die pad is then displaced into engagement with a sheet metal material and a bore is formed in both the stripper insert and the sheet metal material by the axial advancement therethrough of a reciprocal punching tool. Thereafter, the die pad is raised, the punched sheet metal material is removed, and another sheet metal portion is positioned in alignment with the punching tool and the previously-punched bore in the stripper insert.

The previously discussed advantages of the present invention will be more fully appreciated from the following description and the appended claims.

DETAILED DESCRIPTION OF THE DISCLOSED EMBODIMENT

Figure 1:
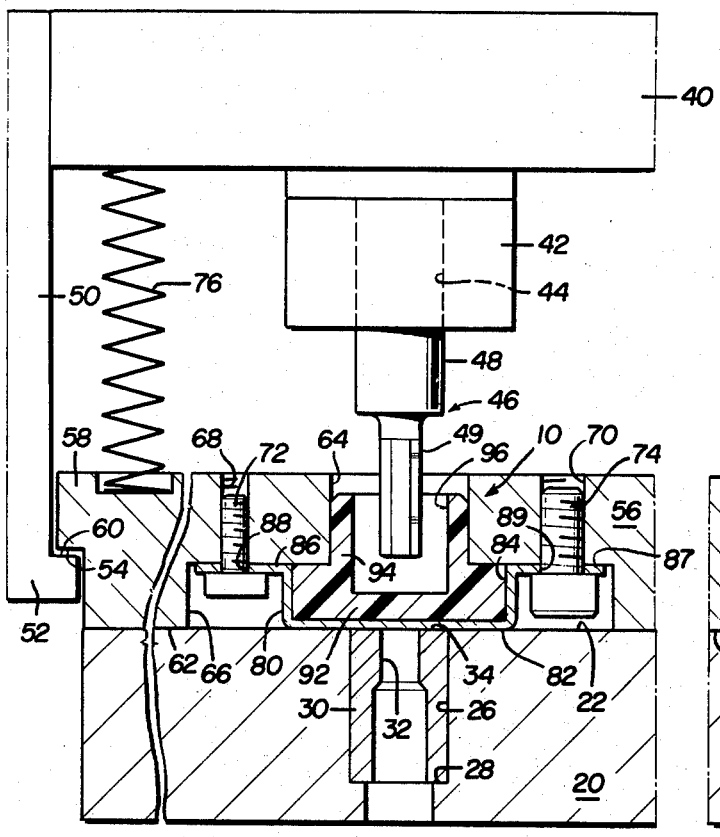
FIG. 1 is an elevational view of a sheet punching apparatus, including the stripper insert of the present invention.

Referring now to the drawings, reference numeral 10 indicates the novel stripper insert of the present invention as secured in position in a sheet punching apparatus, the novel stripper insert to be more fully described in following portions of the disclosure.

The sheet punching apparatus is somewhat conventional and includes a fixed lower die shoe 20 including a flat support surface 22 on which sheet material may be supported for a punching operation. A bore 26 is provided in the lower die shoe and includes a step or ledge 28 for supporting a punch guide insert 30 positioned within the bore 26. The punch guide insert 30 includes a bore 32 to receive the reciprocal punching tool during the punching operation and to receive punched slugs of sheet metal material. An upper, generally flat surface 34 of the punched guide insert 30 supports the sheet material locally of the region to be punched and is substantially coplanar with the flat support surface 22 of fixed die pad 20.

An upper die shoe 40 is positioned above the fixed lower die shoe 20 and is vertically reciprocated by a conventional hydraulic power source (not shown). A punch holder 42 is secured to a lower surface of the vertically reciprocal upper die shoe 40. The punch holder 42 includes a circular bore 44 for receiving a cylindrical shaft 48 which surmounts a longitudinally extending punching portion 49 of punching tool 46, the cylindrical shaft 48 being retained within the punch holder 42 by suitable means such as a plurality of conventional set screws (not shown).

A pad retainer arm 50 extends vertically downwardly from the upper die shoe 40 and terminates at a lower end in an inwardly directed flange 52. As illustrated in FIG. 1, flange 52 includes an upwardly facing support ledge surface 54 in overlapping relationship with a surface 60 on an outwardly directed flange on a vertically moveable die pad 56. As will be discussed in greater detail below, flange 52 raises the vertically moveable die pad 56 as the upper die shoe 40 is raised from the position illustrated in FIG. 1, so that sheet material may be indexed during sequential punching operations.

The retainer pad 56 further includes a flat surface 62 to engage and stablize sheet material during the punching operation. A recess 66 is provided in the face of surface 62, with a bore 64 extending axially of the recess through the total thickness of the die pad. Two threaded bores 68 and 70 receive retainer bolts 72 and 74, respectively, to secure the stripper insert 10 in position on the moveable die pad 56. It will be noted from FIG. 1 that these bolt holes and bolts are different in size for purposes to be more fully explained below. A compression spring 76 is also interposed between and suitably secured to the upper die shoe 40 and the moveable die pad 56, for purposes which will also be more fully explained below.

The stripper insert, per se, includes two basic components, a retainer plate 80 and a plastic reinforcement insert 90.

Figure 3:
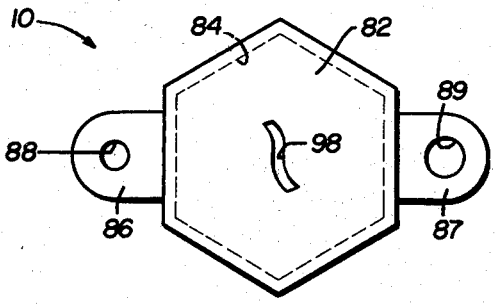
FIG. 3 is a plan view illustrating the retainer plate configuration for the stripper insert.

The retainer plate 80 may be formed, for example, by stamping a thin sheet metal segment into the illustrated configuration, which is basically cup-shaped or dish-shaped in cross-section. This retainer plate, or metallic supporting frame includes a base with a downwardly facing flat end surface 82 which is generally coplanar with flat surface 62 on moveable die pad 56, the flat surface 82 serving to engage, flatten, and stabilize sheet material (not shown) quite locally of the region to be punched. A collar or flange 84 extends upwardly from the retainer base in a direction generally perpendicular thereto. As illustrated in FIG. 3, the flange is hexagonal with the inner surface thereof peripherally engaging the sides of the plastic reinforcement component 90, it being understood that the shape of the flange is not critical. A pair of radially directed, diametrically opposed tabs 86 and 87 extend outwardly from flange 84 and include different sized bores 88 and 89 for receiving the shafts of bolts 72 and 74. Thus, the stripper insert retainer plate 80 is secured to die pad 56 by simply threading bolts 72 and 74 into bores 68 and 70.

Figure 2:
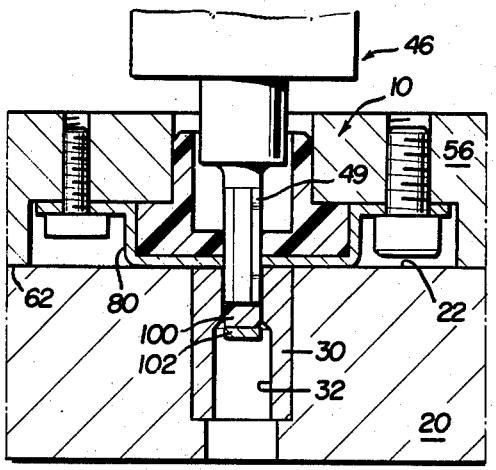
FIG. 2 is a view similar to FIG. 1, illustrating the manner of simultaneously punching a bore through the component parts of the stripper insert.

The plastic reinforcement component 90 may be a separate component formed of any suitable material, such as polyurethane, by conventional injection molding procedures. This component has a generally inverted-T-shaped configuration in cross-section, as illustrated in FIGS. 1 and 2, and includes a hexagonal base 92 which fits within and peripherally engages flange collar 84 of retainer plate 80. An annular, upwardly directed leg 94 having a blind bore 96 extends generally perpendicular to the base 92 to fit within the bore 64 of die pad 56.

One preferred method of assembling and using the stripper insert 10 includes first, bolting the retainer plate 80 to the die pad 56 without the reinforcement component 90. The punch is then advanced through the retainer plate 80 to form a punched opening, the punched slug of sheet metal material being disposed of into the bore 32. After, the punch is retracted, the punched retainer plate is removed from the die pad 56 and the reinforcement component 96 is secured within the plate by a suitable adhesive. Next, the stripper insert is again bolted onto the die pad, and the punching tool 49 is advanced to punch an opening through the reinforcement component in axial alignment with the previously punched opening in the retainer plate. The stripper insert and the die assembly is now ready to punch openings in sheet stock material, which will be indexed into position on support surface 22, when die pad 56 is raised.

In an alternative method of assembling and using the stripper insert 10, as illustrated in FIGS. 1 and 2, the plastic reinforcement component 90 is first axially inserted into and adhesively secured to the cup-shaped metallic stabilizer 90. Of course, plastic insert 90 could be injection molded as an integral component with retainer plate 90, thereby eliminating this first assembly step. Next, the assembled components of the stripper insert are secured to the moveable die pad 56, which will be raised from the position as illustrated in FIG. 1, by inserting bolts 72 and 74 through openings 88 and 89 into bolt holes 68 and 70, respectively. Thus positioned, the insert punching operation may be initiated with or without a sheet metal strip supported on the lower die shoe 20 for a simultaneously punching operation.

A typical punching operation would proceed as follows. First, the upper die shoe 40 would be in a position above that which is shown in FIG. 1. Thus, ledge 52 of pad retainer arm 50 would be supporting die pad 56 in a position above lower die shoe 20 so that the stripper insert 10 may be attached to the die pad. Next, the upper die shoe 40 will be lowered by a conventional hydraulic power source from the raised position to the position illustrated in FIG. 2 where punch 46 has advanced through the component parts of stripper insert 10, and into the bore 32 of punch guide insert 30, in accordance with the second disclosed method of punching the insert. During this downward movement, die pad 56 will be positioned in engagement with sheet material 24 substantially as illustrated in FIG. 1, with further downward movement of upper shoe 40 resulting in continued downward movement of flange 52 and further relative displacement of surfaces 54 and 60. Thereafter, upper die shoe 40 moves downwardly relative to die pad 56 and spring 76 is compressed to exert an increasing biasing force on retainer pad 56 for flattening and stabilizing sheet material, when positioned on surface 22 during the sheet punching operation. It will be noted from FIG. 1, that the length of pad retainer arm 50 and the positioning of surfaces 54 and 60 are such that the lower terminal end of punch 46 is at least slightly spaced from the bottom of the blind bore 96 when the bottom surface 62 of die pad 56 engages surface 22. This dimensional relationship is provided so that the punching action through the stripper insert 10 is not initiated until after being placed in supporting, abutting relationship against surface 22.

Continued downward movement of upper die shoe 40 causes punching tool 46 to advance through the stripper insert, forcing slugs of material into the bore 32 of punch guide 30. These slugs of material are shown in FIG. 2 by reference numerals 100 and 102, slug 100 being from plastic reinforcing component 90 and slug 102 being from retainer plate 80. Of course, if a stripper sheet material 24 is positioned in the die between surfaces 22 and 62 during the stripper insert punching operation, a slug of sheet material would also be formed. Further, if the retainer plate 80 is punched first without the reinforcement component, only a slug 102 would be formed, and then slug 100 would be formed in a subsequent punching step.

Thereafter, upper die shoe 40 is raised to axially withdraw punch 49 upwardly through the stripper insert 10. During similar forward advancement strokes when sheet material is being punched, the stripper insert 10 exerts pressure against the sheet material portion circumscribing the just-punched hole, eliminating the formation of a burr. Continued upward movement of upper die shoe 40 causes support ledge surface 54 to engage surface 60 and thereby raise die pad 56 from engagement with sheet material 24. Next, a sheet material portion is indexed into position on lower die shoe 20. Upper die shoe 40 is then again lowered to cause punching tool 46 to extend through the previously punched hole 98 in the stripper insert 10 to punch a slug of material from the sheet material only.

FIG. 3 illustrates that the punched hole 98 has an irregular configuration corresponding to the cross-sectional configuration of the terminal punching end portion 49 of punching tool 46. The present invention accommodates such irregular shaped configurations and eliminates machining required in prior art stripper insert components, as more fully discussed in earlier portions of this disclosure.

It is common to replace punching tools in a die punching apparatus to provide punched holes in the sheet material of desired configuration. When this becomes necessary in the present invention, the punching tool 46 and stripper insert 10 are simply removed and replaced with another punching tool and stripper insert. The next time that punching tool 46 with its irregular configuration is used, stripper insert 10 is relocated in position by bolts 72 and 74. Since these bolts have different sizes, and since the openings 88 and 89 in the tabs of the stripper insert 10 have different sizes, accurate relocation is easily acheived.

Figure 4:
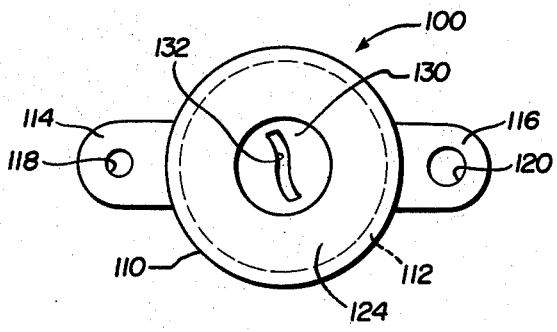
FIG. 4 is a plan view illustrating an alternative embodiment of the stripper insert.

FIG. 4 illustrates an alternative embodiment for a stripper insert 100, including a dished retainer cup 110 and a plastic component 130. In this embodiment, the plastic component 130 may be identical to component 92 in every respect, except for a circular base which mates with an annular flange 112 of retainer cup 110. Diametrically opposed tabs 114 and 116 extend radially from the retainer flange and include different-sized openings 118 and 120 to receive securing bolts, as previously explained.

The primary point of difference between the embodiments of FIGS. 3 and 4 relates to the provision of a previously-formed opening 122 in the base 124 of retainer 110. This arrangement is particularly suitable for use with a pilot punch—i.e. a pointed punch-like tool that positions the sheet metal—but is equally adaptable for use with a punching tool as shown in FIGS. 1 and 2.

To assemble, punch and use this embodiment, the base 130 of the plastic component would be adhesively secured within the retainer 100 which is then bolted to a reciprocal die pad. A punching tool then punches an opening 132 through the plastic member only, prior to or simultaneously with a sheet punching operation.

Having therefore completely and fully described my invention, I now claim:

1. For use in a sheet metal punching assembly including a reciprocal stripper plate and a punching tool reciprocal relative to the plate, a stripper insert comprising a dished metal retainer having a peripheral flange, means for securing the retainer to the stripper plate, and a plastic component surrounded by the retainer flange so that said component can be retained by said retainer for reciprocation with said plate, the plastic component when so retained having a reduced thickness portion for alignment with the reciprocal punching tool of the punching assembly, the stripper insert when so retained to be punched by said reciprocal punching tool to form a bore therethrough (a) which is substantially perpendicular to the reduced thickness portion of the plastic component and (b) which has a configuration substantially identical to the cross-sectional shape of the punching tool.

2. A stripper insert for attachment to a sheet punching assembly in alignment with a reciprocal punching tool, comprising:

a unitary retainer formed of sheet metal material, including (a) a segment for engaging sheet material during the punching operation, and (b) a collar extending from and being generally perpendicular to said segment;

a plastic reinforcing component positioned within the retainer collar and having a base with (a) a peripheral surface engaging the inner peripheral surface of the frame collar and (b) a reduced thickness portion for placement in alignment with the reciprocal punching tool;

the retainer and reinforcing component to be punched by the reciprocal punching tool while attached to the sheet punching assembly, to form a stripper insert opening having a configuration substantially identical to the cross-sectional configuration of the punching tool.

3. The stripper insert defined in claim 2, wherein a pair of radially directed, diametrically opposed tabs extend outwardly from the retainer collar, each tab having an opening therein for receiving a threaded bolt shaft, with one opening being larger than the other.

4. The stripper insert defined in claim 3, wherein said plastic reinforcement component includes a generally annular portion extending away from the base thereof, said annular portion being generally perpendicular to the reduced thickness portion for fitting within a complementary-configured opening in the punching assembly, the reciprocal punching tool being received within the annular portion during the punching operation.

5. In an apparatus for punching openings of predetermined configuration in sheet material, a support surface on which the sheet material is positioned, the support surface having an opening in axial alignment with a vertically reciprocal punching tool, the opening of the support surface receiving at least a portion of the punching tool and a punched slug of sheet material during the punching operation, a vertically reciprocal die pad interposed between the punching tool and the support surface, the die pad including (a) an engagment surface corresponding in configuration to the supporting surface for engaging and stabilizing the sheet material during the punching operation and (b) an opening in axial alignment with the support surface opening to accommodate the downward displacement of the punching tool through the sheet material, an insert secured to the die pad in axial alignment with (a) the punching tool, (b) the support surface opening and (c) the die pad opening, said insert stabilizing the sheet material locally of the punching tool and support surface opening during the punching operation, the improvement of said insert including:

a metal base having a lower metal surface for face to face contact with the sheet material during the punching operation, a plastic reinforcement strip interposed between the die pad and the metal base, the plastic reinforcement strip and the metal base having axially aligned openings, the opening in the plastic strip being substantially identical to the cross-sectional configuration of the punching tool and having been formed by axial reciprocation of said punch through the plastic insert while secured in position on said die pad.

6. The apparatus as defined in claim 5, characterized by the insert further including flanges extending from said base in a direction away from said support surface, said flanges being generally perpendicular to the metal base and peripherally circumscribing the plastic reinforcement strip, and a pair of tabs axially spaced from the metal base and extending radially outward from a pair of said flanges, each tab being secured in position against a recessed surface of a die pad by respective bolts threadedly received in the die pad and extending through a bore in the tab.

7. An insert for attachment to a sheet punching die in axial alignment with a reciprocal punching tool, comprising:

a plastic reinforcing component having a base with an axial opening to receive a reciprocal punching tool during the sheet punching operation, one end of said base including a generally flat face substantially perpendicular to said opening, the other end of said base having a generally annular projection extending therefrom generally coaxial of said opening, the annular projection being adapted for insertion within a complementary-shaped bore in the punching die and having an internal diameter greater than that of the base opening to freely receive the punching tool during the punching operation; and a cup-shaped retainer plate including (a) a base having a first flat face in engagement with the flat face of the reinforcement component and a second flat face for engaging and stabilizing sheet material during the punching operation, the base having an axial opening therethrough in alignment with the opening in the base of the reinforcement component, and (b) a flange generally perpendicular to the base and peripherally engaging the sides on the base of the reinforcing component; the aligned openings in the bases of each component being formed by axial advancement of the punching tool therethrough.

8. In a method of punching sheet material, the steps of:

1. securing a stripper insert to a sheet punching assembly in interposed, vertical alignment between a reciprocable punching tool and an opening in a lower die shoe, the insert including a dished metal retainer and a solid plastic segment in alignment with the punching tool;
2. downwardly displacing the punching tool to sequentially (a) axially advance the punching tool through the stripper insert to punch a slug from the solid plastic segment and form an opening therein having a configuration substantially identical to the cross-section of the punching tool and (b) extend the punching tool at least partially into the lower die shoe opening;
3. vertically retracting the punching tool;
4. positioning sheet material on the lower die shoe in vertical alignment with the reciprocable punching tool;
5. downwardly displacing the punching tool to sequentially (a) advance through the previously punched opening in the stripper insert and (b) advance through the sheet material to punch and opening therein; and
6. vertically retracting the punching tool.

9. The method as defined in claim 8, wherein Step (2a) is characterized by punching a slug from both the solid plastic segment and the dished metal retainer.

10. The method as defined in claim 9, further including the steps of positioning a first sheet segment on the lower die shoe in vertical alignment with the reciprocable punching tool prior to Step (2); Step (2) being characterized by also punching an opening in said first sheet segment; and displacing said first sheet segment from the lower die shoe between Steps (3) and (4).

* * * * *